US006657171B1

(12) United States Patent
Huynh et al.

(10) Patent No.: US 6,657,171 B1
(45) Date of Patent: Dec. 2, 2003

(54) TOROIDAL WAVEGUIDE FOR A MICROWAVE COOKING APPLIANCE

(75) Inventors: Trieu Huynh, Ooltewah, TN (US); Sondra Denice Proffitt, Springfield, TN (US); Robert Z. Whipple, Jr., Louden, TN (US)

(73) Assignee: Maytag Corporation, Newton, IA (US)

( * ) Notice: Subject to any disclaimer, the term of this patent is extended or adjusted under 35 U.S.C. 154(b) by 1 day.

(21) Appl. No.: 10/299,918

(22) Filed: Nov. 20, 2002

(51) Int. Cl.[7] ..... H05B 6/74

(52) U.S. Cl. ..... 219/746; 219/748; 219/751; 219/757

(58) Field of Search ..... 219/746, 748, 219/749, 750, 751, 757, 681, 685

(56) References Cited

U.S. PATENT DOCUMENTS

| | | | | |
|---|---|---|---|---|
| 3,439,143 A | | 4/1969 | Cougoule | |
| 3,577,207 A | * | 5/1971 | Kirjushin | 219/748 |
| 3,746,823 A | | 7/1973 | Whiteley | |
| 3,878,350 A | | 4/1975 | Takagi | |
| 4,223,194 A | | 9/1980 | Fitzmayer | |
| 4,327,266 A | | 4/1982 | Austin et al. | |
| 4,335,289 A | | 6/1982 | Smith | |
| 4,430,538 A | | 2/1984 | Suzuki et al. | |
| 4,833,286 A | | 5/1989 | Ohnishi | |
| 4,857,685 A | | 8/1989 | Vigano et al. | |
| 4,866,233 A | | 9/1989 | Fritz | |
| 5,880,442 A | * | 3/1999 | You | 219/746 |
| 5,990,466 A | | 11/1999 | McKee et al. | |
| 6,008,483 A | | 12/1999 | McKee et al. | |
| 6,469,287 B1 | * | 10/2002 | Kim | 219/751 |

FOREIGN PATENT DOCUMENTS

| | | | | |
|---|---|---|---|---|
| EP | 0 632 678 | * | 1/1995 | 219/748 |
| JP | 54-2531 | | 1/1979 | |
| JP | 6-260277 | | 9/1994 | |
| JP | 7-22171 | | 1/1995 | |

* cited by examiner

*Primary Examiner*—Philip H. Leung
(74) *Attorney, Agent, or Firm*—Diederiks & Whitelaw, PLC

(57) ABSTRACT

A microwave delivery system for a cooking appliance includes a toroidal waveguide having a ring diameter twice that of the wavelength of the microwaves produced by a magnetron, and a cross-sectional diameter equal to one-half of the produced microwaves. The waveguide includes a plurality of cavity excitation ports through which the microwaves enter a cooking cavity. The delivery system further includes a rotating stirrer positioned within the waveguide. The stirrer includes a plurality of openings which become aligned with the cavity excitation ports when the stirrer is rotated to create a uniform, high energy pattern of microwave energy to enter the cooking cavity. Finally, the waveguide includes a plurality of openings along spaced portions thereof to allow a flow of air through the waveguide.

17 Claims, 3 Drawing Sheets

TOROIDAL WAVEGUIDE FOR A MICROWAVE COOKING APPLIANCE

BACKGROUND OF THE INVENTION

1. Field of Invention

The present invention pertains to the art of cooking appliances and, more particularly, to a microwave energy delivery system including a toroidal waveguide which efficiently delivers a substantially uniform microwave energy field into a cooking chamber.

2. Discussion of Prior Art

Cooking appliances utilizing directed microwave energy fields to cook food items have existed for some time. In general, a cooking process is performed by heating the food item by directing a standing microwave energy field into an oven cavity such that the microwave energy field reflects about the oven cavity and impinges upon the food item. As the microwave energy field impinges upon the food item, the field is converted into heat through two mechanisms. The first, ionic heating is caused by the liner acceleration of ions, generally in the form of salts present within the food item. The second is the molecular excitation of polar molecules, primarily water, present within the food item. However, the nature of the standing waves results in localized areas of high and low energy which cause the food to cook unevenly. This is especially true in larger ovens where the size of the cavity requires a more uniform energy distribution in order to properly cook the food. To attain an even or uniform energy distribution, the microwave energy must be introduced into the oven cavity in a manner which creates a constructive standing wave front which will propagate about the oven cavity in a random fashion.

Various methods of directing microwaves into cooking chambers to minimize hot and cold areas resulting from the existence of high and low energy fields have been proposed in the prior art. These methods range from altering the pattern of the standing waves by varying the frequency of the microwave energy field, to incorporating a stationary mode stirrer which simulates change in the geometric space of the cooking chamber. Methods of changing the wave pattern have also included the incorporation of a rotating blade stirrer which functions to deflect microwave energy into a cooking cavity in various patterns. Traditionally, stirrers have been located in various points in the microwave feed system, ranging from adjacent to a microwave energy source to a position within the cooking chamber itself. Some stirrers include various openings which are provided to disperse standing waves, and others have various surface configurations designed to reflect the standing waves. Stirrers are either driven by a motor or by air currents supplied by a blower. In any event, all of these methods share a common theme, i.e., to reflect and/or deflect the microwave energy into a cooking cavity such that a uniform distribution of standing wave patterns can be achieved.

Other methods of controlling the standing waves include modifying the structure of the waveguide itself. The prior art provides examples of waveguides shown as cylinders, square boxes, and a variety of other configurations designed to cause the standing waves to interfere with one another in a manner which results in a randomized wave front such that a maximum energy field is directed into the cooking chamber. Other designs include matching the dimensions of the waveguide to the wavelengths of the standing wave pattern. However, these designs, while effective to a point, have failed to adequately address the problem of energy loss due to energy absorption on the waveguide surface.

As the desire to increase the sizes of oven cavities has risen, and microwave technology has been combined into conventional or convection ovens, the uniform distribution of the standing waves has become of even greater concern. For this reason, manufacturers have modified their designs to include multiple magnetrons, multiple stirrers, and motor driven, variable speed stirrers, all of which are intended to create a random wave pattern thought to be of a more uniform character. Still other designs include structure for rotating or moving food within the cooking chamber. Ovens employing this method, position the food on a platter which is rotated through the standing wave patterns such that the food is more uniformly exposed to the microwaves.

While these methods are fine for smaller ovens, they are hardly practical for larger, conventional, ovens where space is more of a concern. Certainly, in an age where energy consumption is of particular concern, the need for an energy efficient cooking appliance is desired. Based on the above, there exists a need for a microwave delivery system which will direct a uniform standing wave pattern into a cooking chamber in a manner that minimizes energy losses within a waveguide, yet provides a uniform, maximum energy field to the cooking chamber.

SUMMARY OF THE INVENTION

The present invention is directed to a microwave cooking appliance including a toroidal-shaped waveguide preferably having a ring diameter equal to twice the standing wavelength, and a cross-sectional diameter equal to one-half the standing wavelength. The design of the waveguide causes a standing wave to impinge upon an inner surface of the waveguide at points of zero energy such that energy absorbed by the waveguide is minimized. Additionally, the design of the ring diameter causes constructive interferences within the waveguide, thereby a high energy node about the circumference of the waveguide. Furthermore, a plurality of cavity excitation ports are arranged about the bottom portion of the waveguide.

In accordance with a preferred embodiment, the microwave delivery system of the present invention further includes a mode stirrer having a plurality of openings evenly spaced about the periphery of the stirrer. Specifically, when rotated, the openings operate as shutters. As the openings align with the cavity excitation ports, passages are created to allow the microwave energy field into the cooking chamber. The operation of the stirrer creates a uniform pattern of microwave energy to be directed onto a food item placed within the cooking chamber.

In any event, additional objects, features and advantages of the invention will become more readily apparent from the following detailed description of a preferred embodiment of the invention, when taken in conjunction with the drawings wherein like reference numerals refer to corresponding parts in the several views.

DETAILED DESCRIPTION OF THE INVENTION

Figure 1:
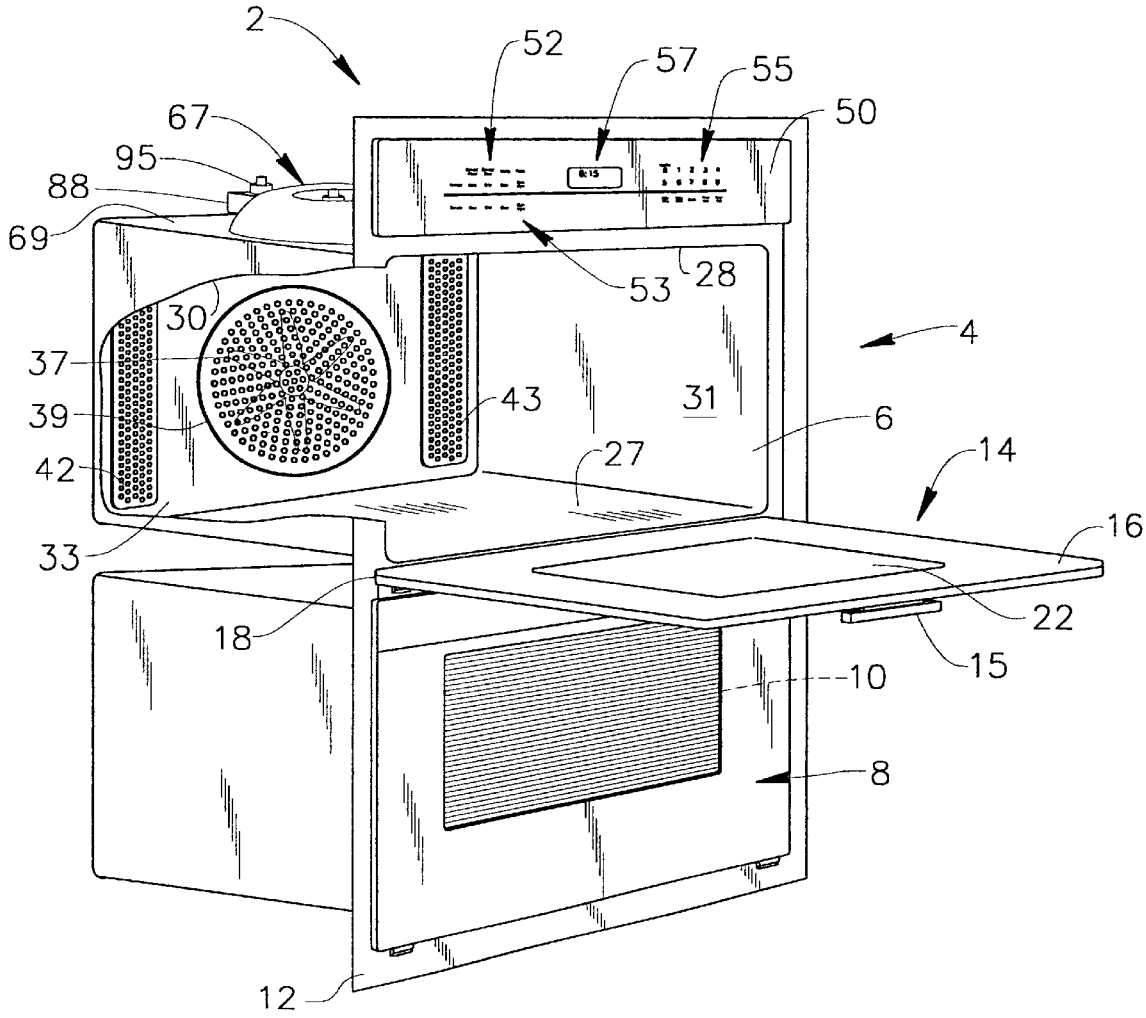
FIG. 1 is a perspective view of a combination microwave/convection wall oven including a toroidal waveguide constructed in accordance with the present invention.

With initial reference to FIG. 1, a microwave cooking appliance constructed in accordance with the present invention is generally indicated at 2. Although the form of cooking appliance 2 in accordance with the present invention can vary, the invention is shown in connection with cooking appliance 2 depicted as a wall oven. More specifically, in the embodiment shown, cooking appliance 2 constitutes a dual oven wall unit including an upper oven 4 having upper cooking chamber 6 and a lower oven 8 having a lower cooking chamber 10. In the embodiment shown, upper oven 4 is adapted to perform a rapid cook or combination microwave/convection cooking process, and lower oven 8 is provided to perform a standard convection and/or radiant heat cooking operation. As shown, cooking appliance 2 includes an outer frame 12 for supporting upper and lower cooking chambers 6 and 10.

In a manner known in the art, a door assembly 14 is provided to selectively provide access to upper cooking chamber 6. As shown, door assembly 14 is provided with a handle 15 at an upper portion 16 thereof. Door assembly 14 is adapted to pivot at a lower portion 18 to enable selective access to within cooking chamber 6. In a manner also known in the art, door 14 is provided with a transparent zone 22 for viewing cooking chamber 6 while door 14 is closed.

As best seen in FIG. 1, cooking chamber 6 is defined by a bottom portion 27, an upper portion 28, opposing side portions 30 and 31, and a rear portion 33. Bottom portion 27 is preferably constituted by a flat, smooth surface designed to improve the cleanability, serviceability, and reflective qualities of cooking chamber 6. In the embodiment shown, arranged on rear portion 33 is a convection fan 37 having a perforated cover 39 through which heated air can be withdrawn from cooking chamber 6. Heated air is re-introduced into cooking chamber 6 through vents 42 and 43 arranged on either side of fan 37. Although cooking appliance 2 is depicted as a wall oven, it should be understood that the present invention is not limited to this model type and can be incorporated into various types of oven configurations, e.g., cabinet mounted ovens, as well as slide-in and free standing ranges.

Further shown in FIG. 1, cooking appliance 2 includes an upper control panel 50 incorporating first and second rows of oven control button rows 52 and 53. Control buttons 52 and 53, in combination with a numeric pad 55 and a display 57, enable a user to establish particular cooking operations for upper and lower ovens 4 and 8 respectively. Since the general programming and operation of cooking appliance 2 is known in the art and does not form part of the present invention, these features will not be discussed further here. Instead, the present invention is particularly directed to the incorporation and construction of waveguide 67 for delivering a microwave energy field into cooking chamber 6, which provides for at least a portion of the cooking operation, as will be detailed fully below.

Figure 2:
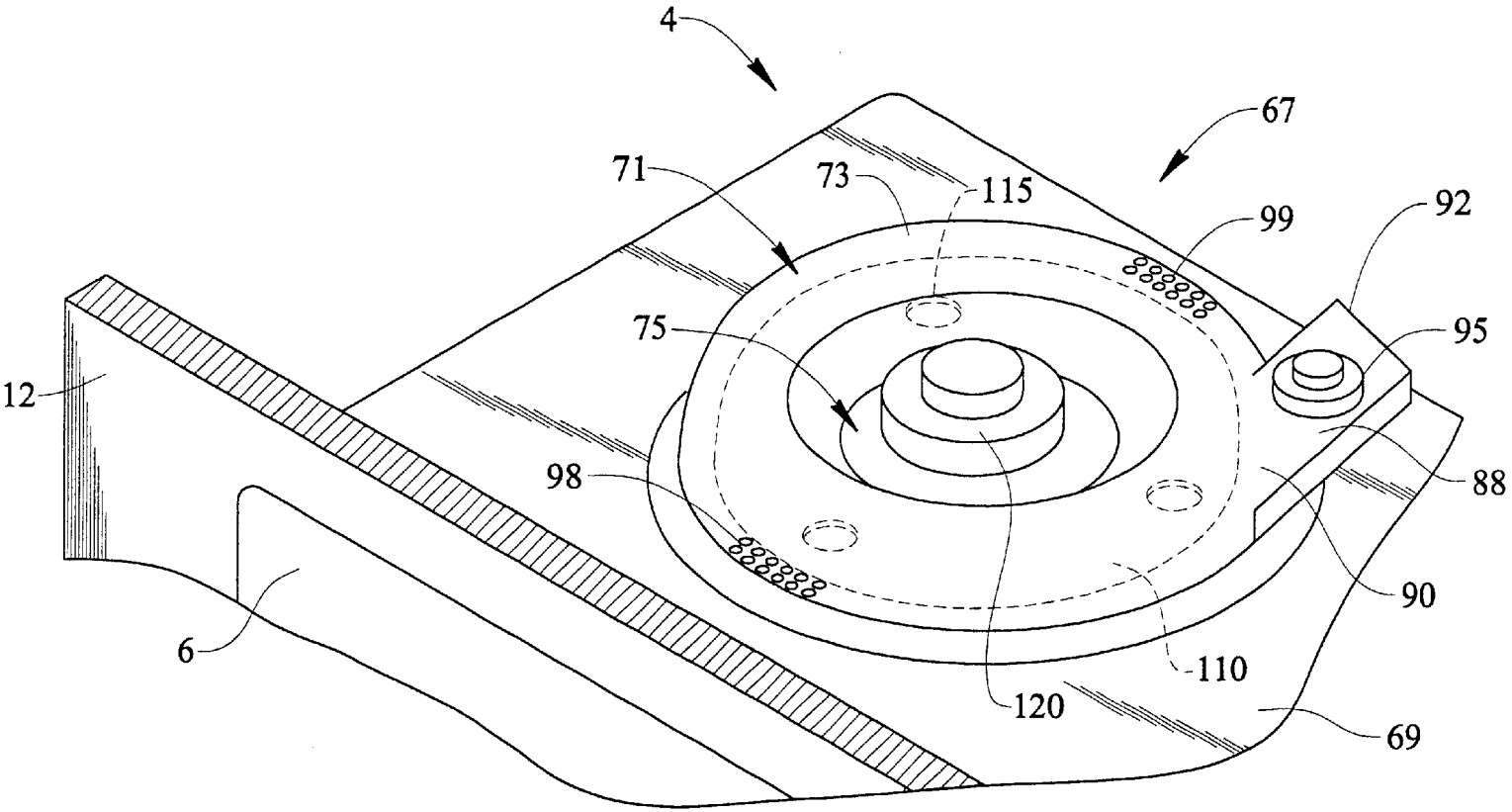
FIG. 2 is a perspective view of the toroidal waveguide mounted in accordance with the present invention.
Figure 3:
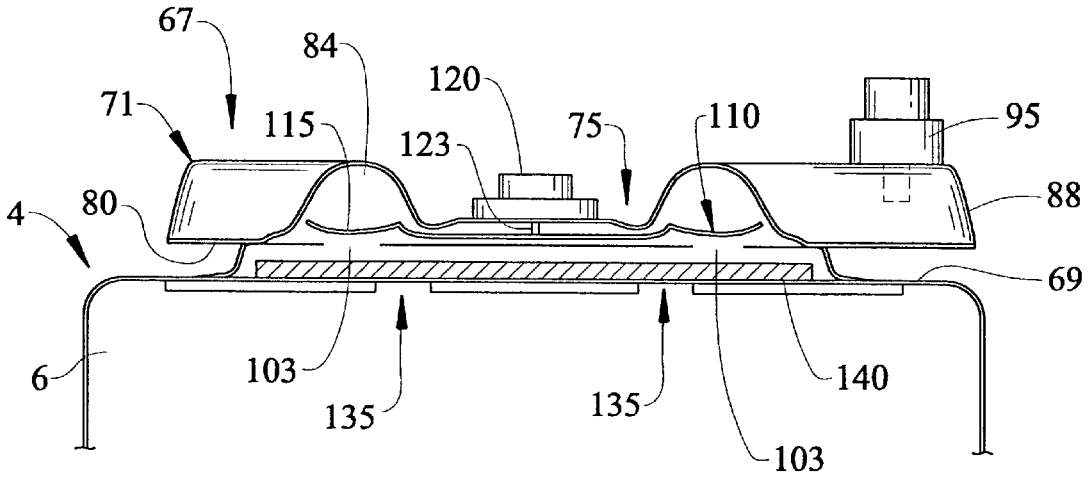
FIG. 3 is a partial cross-sectional view of the toroidal waveguide of FIG. 2.
Figure 4:
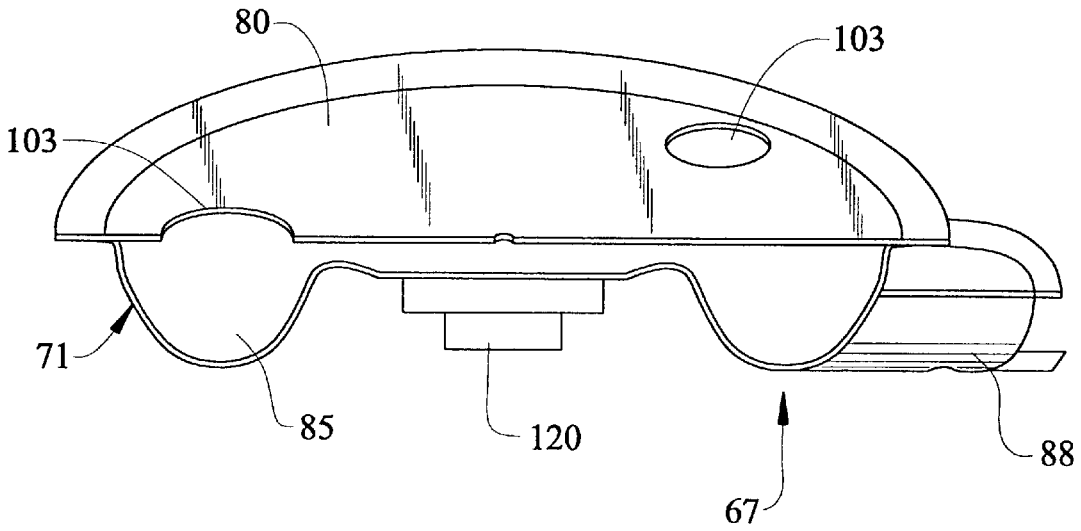
FIG. 4 is a cross-sectional view of the toroidal waveguide of FIG. 3 inverted.

With reference to FIGS. 2–4, waveguide 67 is shown mounted on an exterior upper portion 69 of cooking chamber 6. More specifically, waveguide 67 includes an annular toroidal ring cover 71 having an upper surface 73 defining a central depression 75, and a bottom surface 80. In a preferred form of the invention, waveguide 67 further includes a hollow interior portion 84 having a defined torus ring or cross-sectional diameter and a defined centerline diameter. Waveguide 67 is preferably formed from coated aluminum which provides enhanced reflective qualities, while also decreasing any IR emissivity. As such, energy loses due to the absorption of microwave energy are minimized. In a preferred arrangement, the torus ring diameter of waveguide 67 is set equal to ½λ, and the centerline diameter of waveguide 67 is equal to 2λ, where λ is defined as the wavelength of the microwave energy field transmitted into waveguide 67.

As best shown in FIG. 2, a launching zone 88 is provided which includes a first end defining an exit 90 opening into waveguide 67, and a second, terminal end 92. Mounted on an upper portion of terminal end 92 is a magnetron or microwave emitter 95. In a manner known in the art, magnetron 95 emits microwaves of a defined wavelength (λ) into launching zone 88. In a preferred configuration, magnetron 95 emits microwave energy at a wavelength of 2.45 GHz. However, it should be noted that waveguide 67 of the present invention is adaptable to any acceptable wavelength used for cooking.

Referring further to FIG. 2, arranged about a front portion of waveguide 67 are a plurality of inlet openings 98. More specifically, inlet openings 98 are positioned to allow a flow of cooling air to enter interior portion 84. Additionally, a plurality of exhaust openings 99 are arranged on a rear portion of waveguide 67, adjacent to launching zone 88, to allow heated air to escape from interior portion 84. In this manner, waveguide 67 also serves as an air duct, further eliminating the amount of insulation required over cooking chamber 6. Inlet openings 98 and exhaust openings 99 are sized and positioned such that the reflected microwave energy field will not escape from interior portion 84.

As best seen in FIGS. 3 and 4, a plurality of cavity excitation ports 103 are arranged about bottom surface 80 of waveguide 67. Specifically, cavity excitations ports 103 are located about bottom surface 80 at each point where a maximum energy node will occur. As such, in the most preferred form of the invention, three equally spaced excitation ports are positioned at ½λ points located about bottom surface 80.

Referring back to FIGS. 2 and 3, a stirring plate 110 is shown rotatably mounted within interior portion 84. In a preferred form of the invention, a plurality of openings 115 are arranged about stirring plate 110. In the most preferred form of the invention, the number of openings 115 correspond to the number of cavity excitation ports 103. Stirring plate 110 is driven by a motor 120 arranged within central depression 75, with motor 120 being drivingly connected to stirring plate 110 through shaft 123. Shaft 123 is formed from a dielectric material such that it does not interfere with the microwave energy field. Alternatively, in place of using a dielectric material, shaft 123 can be grounded to cooking appliance 2 to avoid interference with the microwave energy field.

Reference will now be made to FIGS. 1–4 is describing a preferred method of operation of cooking appliance 2. Although the described method will be focused on the microwave aspects of the cooking process, it should be understood that the present invention is equally applicable to a combination microwave/convection oven and can even include a radiant heating feature. Prior to initializing a cooking operation, a food item is placed within cooking chamber 6. Control 52 is operated, either individually or in combination with control 55, to select a desired cooking operation. Upon activation, magnetron 95 begins to emit a microwave energy field into waveguide 67 through launching zone 88. Most preferably, motor 120 begins to rotate stirring plate 110 to influence the microwave energy field emitted by magnetron 95. In general, stirring plate 110 acts to control, shift and modify the microwave energy field. As stirring plate 110 rotates, openings 115 come into alignment with cavity excitation ports 103. In this manner, cavity excitation ports 103 are intermittently opened and closed such that one, two or all three of ports 103 are opened at any given time. The opening pattern of excitation ports 103 influences the pattern of microwave energy as the energy field is transmitted into cooking chamber 6 to cook the food item.

In a preferred form of the invention, a plurality of microwave windows 135 are positioned below the cavity excitation ports 103 respectively. Therefore, microwave energy is transmitted from waveguide 67 through microwave windows 135 and into cooking chamber 6 whereupon the microwave energy impinges upon the food item undergoing the selected cooking operation. As the microwave energy is released through each cavity excitation port 103 into cooking chamber 6, constructive wave interferences are generated within cooking chamber 6. In this manner, the microwave energy field is caused to move about cooking chamber 6 in such a random fashion so as to establish a highly uniform RF energy field. Accordingly, the food item is subjected to a uniform cooking process, such that localized hot and cold spots are substantially eliminated.

In further accordance with the invention, a waveguide cover or protective plate 140 is arranged between waveguide 67 and microwave windows 135. In the embodiment shown, waveguide cover 140 is designed to withstand the highest temperatures developed within the oven. Additionally, waveguide cover 140 is formed from a material which is transparent to microwave energy. Examples of acceptable materials for waveguide cover 140 are: Pyrex glass, ceramic sheets, mica, silicon mica and the like. However, it should be understood that a wide variety of other materials are also acceptable. In general, microwave cover 140 functions to prevent cooking byproducts, such as grease, oil, fats and the like, released from the food item during the cooking process from entering waveguide 67.

Based on the above, it should be readily apparent that the present invention provides an microwave energy delivery system in the form of a toroidal waveguide that creates a uniform cooking environment for a food item. Although described with reference to a preferred embodiment of the invention, it should be readily understood that various changes and/or modifications can be made to the invention without departing from the spirit thereof. Particularly, it should be recognized that the use of terms such as top, bottom, left and right have been presented for illustrative purposes only and should not be considered to limit the scope of the present invention. For example, although waveguide 67 has be described as being arranged above cooking chamber 6, waveguide 67 could be repositioned, such as on bottom portion 27 or rear portion 33 without departing from the invention. Instead, the invention is only intended to be limited by the scope of the following claims.

We claim:

1. A microwave cooking appliance comprising:

a cooking chamber;

a toroidal-shaped waveguide exposed to the cooking chamber, said waveguide including a hollow interior portion defined by at least first and second surfaces;

a launching zone including a first end opening into the interior portion of the waveguide, and a second, terminal end;

a microwave emitter connected to the launching zone, said microwave emitter being adapted to emit microwave energy of a defined wavelength into said launching zone;

a plurality of cavity excitation ports located in the second surface of said waveguide and leading to the cooking chamber, said cavity excitation ports being adapted to allow the passage of microwave energy from said waveguide to said cooking chamber; and a stirring plate rotatably mounted within said waveguide, said stirring plate including a plurality of openings, wherein rotation of the stirring plate causes one or more of said openings to periodically overlap one or more of the cavity excitation ports thereby allowing a pattern of microwave energy to pass from the waveguide, through the cavity excitation ports and into the cooking chamber.

2. The microwave cooking appliance of claim 1, wherein the hollow interior portion has a cross-sectional diameter equal to ½ the wavelength of the microwave energy generated by the microwave emitter.

3. The microwave cooking appliance of claim 1, wherein the waveguide has a centerline ring diameter equal to twice the wavelength of the microwaves generated by the microwave emitter.

4. The microwave cooking appliance of claim 3, wherein the plurality of cavity excitation ports are aligned with a maximum energy node created within the waveguide.

5. The microwave cooking appliance of claim 4, wherein three cavity excitation ports are equally spaced about the waveguide.

6. The microwave cooking appliance of claim 1, wherein said waveguide defines a central depression, wherein said microwave cooking appliance further comprises a motor mounted within the central depression, said motor being adapted to provide a rotational driving force to the stirring plate upon activation of the microwave cooking appliance.

7. The microwave cooking appliance of claim 1, further comprising:

a plurality of inlet openings located about a portion of the waveguide, said inlet openings being adapted to permit a flow of air into the waveguide.

8. The microwave cooking appliance of claim 7, further comprising:

a plurality of outlet openings located about another portion of the waveguide, said outlet openings defining an exhaust path for the flow of air.

9. The microwave cooking appliance of claim 1, wherein the hollow interior portion of the waveguide is formed from coated aluminum.

10. The microwave cooking appliance of claim 1, further comprising:

a waveguide cover positioned over the cavity excitation ports, said waveguide cover preventing byproducts generated in the cooking chamber from a cooking process from entering the waveguide.

11. The method of supplying microwave energy to a cooking chamber comprising:

generating a microwave energy field;

directing the microwave energy field into a toroidal waveguide;

rotating a stirrer in the waveguide;

intermittently exposing a plurality of cavity excitation ports formed in the waveguide upon rotation of the stirrer; and directing the microwave energy field through the cavity excitation ports into the cooking chamber to impinge upon and cook a food item in the cooking chamber.

12. The method of claim 1, wherein the microwave energy field is directed into the waveguide with a microwave wavelength equal to ½ a ring diameter of the waveguide such that constructive interferences are generated within the waveguide resulting in a high energy node around the ring diameter.

13. The method of claim 12, further comprising: locating the cavity excitation ports on a bottom surface of the waveguide such that the excitation ports are aligned with the high energy node created within the waveguide.

14. The method of claim 11, further comprising: driving the stirrer through a motor mounted within a central depression of the toroidal waveguide.

15. The method of claim 11, further comprising: drawing a flow of air, through a plurality of inlet openings, into the waveguide.

16. The method of claim 15, further comprising: exhausting a flow of air, through a plurality of outlet openings, from the waveguide.

17. The method of claim 11, further comprising: preventing byproducts generated in the cooking chamber from a cooking process from entering the waveguide through the cavity excitation ports.

* * * * *